US009829235B2

(12) United States Patent
Visin

(10) Patent No.: US 9,829,235 B2
(45) Date of Patent: Nov. 28, 2017

(54) AIR FLOW DIVERTER FOR EQUALIZING AIR FLOW WITHIN AN ICE MAKING APPLIANCE

(71) Applicant: Whirlpool Corporation, Benton Harbor, MI (US)

(72) Inventor: Jerry M. Visin, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 323 days.

(21) Appl. No.: 14/635,024

(22) Filed: Mar. 2, 2015

(65) Prior Publication Data

US 2016/0258663 A1 Sep. 8, 2016

(51) Int. Cl.
*F25C 1/24* (2006.01)
*F25D 17/06* (2006.01)

(52) U.S. Cl.
CPC ..... *F25C 1/246* (2013.01); *F25D 17/065* (2013.01); *F25C 2400/10* (2013.01); *F25D 2317/061* (2013.01); *F25D 2317/063* (2013.01)

(58) Field of Classification Search
CPC ..... F25D 2317/063; F25D 2317/061
See application file for complete search history.

(56) References Cited

U.S. PATENT DOCUMENTS

| | | | | |
|---|---|---|---|---|
| 7,752,859 | B2 * | 7/2010 | Lee | F25C 5/187 62/186 |
| 2008/0034780 | A1 * | 2/2008 | Lim | F25C 1/04 62/353 |
| 2010/0313594 | A1 * | 12/2010 | Lee | F25C 1/00 62/340 |
| 2013/0167576 | A1 * | 7/2013 | Kim | F25C 1/00 62/344 |

FOREIGN PATENT DOCUMENTS

| | | | |
|---|---|---|---|
| JP | 8094230 | A | 4/1996 |
| JP | 03253479 | B2 | 2/2002 |
| JP | 2006250489 | A | 9/2006 |
| WO | 2008096245 | | 8/2008 |

* cited by examiner

*Primary Examiner* — Cassey D Bauer
(74) *Attorney, Agent, or Firm* — Price Heneveld LLP

(57) ABSTRACT

An ice maker for a refrigerating appliance includes an ice tray having ice-forming compartments. Each ice-forming compartment includes sidewalls and a base defining an internal freezing chamber. The ice maker also includes an air flow diverter having an outer frame and a plurality of internal diverting fins that define tuned duct flutes for receiving a stream of intake air from an air handling system and distributing the stream of intake air through the plurality of tuned duct flutes as streams of cooling air directed toward the ice-forming compartments. The internal diverting fins include a predetermined spacing pattern that individually tunes each of the tuned duct flutes. The predetermined spacing pattern evenly distributes the stream of intake air among the plurality of tuned duct flutes such that each of the plurality of streams of cooling air include substantially equal air flow rates.

16 Claims, 8 Drawing Sheets

Method 500 for forming an ice-making apparatus for a refrigerating appliance.

AIR FLOW DIVERTER FOR EQUALIZING AIR FLOW WITHIN AN ICE MAKING APPLIANCE

FIELD OF THE INVENTION

The invention is in the field of ice making appliances and methods for creating equalized air flow within the ice making appliance for insuring even ice formation.

BRIEF SUMMARY OF THE INVENTION

An ice maker for a refrigerating appliance includes an ice tray having a plurality of ice-forming compartments. Each of the ice-forming compartments includes sidewalls and a base defining an internal freezing chamber. The ice maker also includes an air flow diverter having an outer frame and a plurality of internal diverting fins defining a plurality of tuned duct flutes for receiving a stream of intake air from an air handling system and distributing the stream of intake air through the plurality of tuned duct flutes as a plurality of streams of cooling air in the direction of the plurality of ice-forming compartments. Each of the plurality of internal diverting fins includes a predetermined spacing pattern that individually tunes each of the plurality of tuned duct flutes. The predetermined spacing pattern evenly distributes the stream of intake air among the plurality of tuned duct flutes such that each of the plurality of streams of cooling air include substantially equal air flow rates to each of the plurality of ice-forming compartments.

An ice maker for a refrigerating appliance includes an ice tray having a plurality of ice-forming compartments. Each of the ice-forming compartments includes sidewalls and a base defining an internal freezing chamber. The ice maker also includes an air flow diverter having an air intake for receiving intake air from an air handler, a distribution region and an exhaust portion, wherein the distribution region and exhaust portion cooperate to direct a plurality of dedicated streams of cooling air in the direction of respective ice-forming compartments of the plurality of ice-forming compartments. A plurality of internal diverting fins is disposed within the distribution region and spaced at a predetermined spacing pattern to evenly distribute the intake air into the dedicated streams of cooling air. Each of the dedicated streams of cooling air includes substantially equal air flow rates to each of the plurality of ice-forming compartments.

A method of forming an ice making apparatus for a refrigerating appliance includes providing a refrigerating appliance having a water distribution system and an air distribution system that can be connected to an ice making apparatus. The method also includes providing an ice maker that can be installed within a portion of the refrigerating appliance, wherein the ice maker can be installed within at least one of a door of the refrigerating appliance, a freezing compartment, a refrigerating compartment, and a mullion. An ice tray is provided for the ice maker, wherein the ice tray includes a plurality of ice-forming compartments. Each of the ice-forming compartments includes sidewalls and a base defining an internal freezing chamber. A predetermined spacing pattern is determined for a plurality of internal diverting fins disposed within an air flow diverter. The predetermined spacing pattern is configured to evenly distribute intake air from the air distribution system into dedicated streams of cooling air separately manipulated by individual tuned duct flutes defined between adjacent internal diverting fins of the plurality of internal diverting fins. Each of the dedicated streams of cooling air includes substantially equal air flow rates to each of the plurality of ice-forming compartments. The air flow diverter is formed having an air intake configured to be coupled to the air distribution system, a distribution region and an exhaust portion. The plurality of internal diverting fins are positioned in the predetermined spacing pattern within the distribution region to form the individual tuned duct flutes. The air flow diverter is installed in the ice maker such that each of the individual tuned duct flutes is configured to direct a dedicated stream of cooling air toward a respective ice-forming compartment. The ice maker is installed within the refrigerator and connecting the air intake to the air distribution system and the water distribution system is placed in communication with the internal freezing chambers.

A method of forming ice within ice-forming compartments of an ice tray is also disclosed. The method includes providing a refrigerator having an ice making appliance that includes an ice tray that defines a plurality of ice-forming compartments, wherein each ice-forming compartment defines an internal freezing chamber within each respective ice-forming compartment. The method also includes providing an air flow diverter that is configured to direct air from an evaporator contained within the refrigerating appliance toward the ice-forming compartments of the ice making appliance. The air flow diverter is designed such that it contains a plurality of internal diverting fins that define a corresponding plurality of tuned duct flutes. Each of the tuned duct flutes is configured to direct a plurality of streams of cooling air, having substantially equal air flow rates, to each of the plurality of ice-forming compartments of the ice making appliance. The method also includes providing an air handler for moving air from the evaporator contained within the refrigerator to the air flow diverter. Another step of the method includes disposing liquid into each of the internal freezing chambers of the corresponding ice-forming compartments. After liquid has been disposed within the internal freezing chambers, the air handler of the refrigerator moves cooled air from the evaporator and to the air flow diverter such that the air flow diverter can distribute the cooled air into the plurality of streams of cooling air that have substantially equal air flow rates. The plurality of streams of cooling air, having substantially equal flow rates, are then directed toward each of the ice-forming compartments to freeze the liquid contained within each of the internal freezing chambers. Once ice is formed within each of the internal freezing chambers, the ice making appliance operates to remove the ice from each of the ice-forming compartments.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

DETAILED DESCRIPTION

Figure 1:
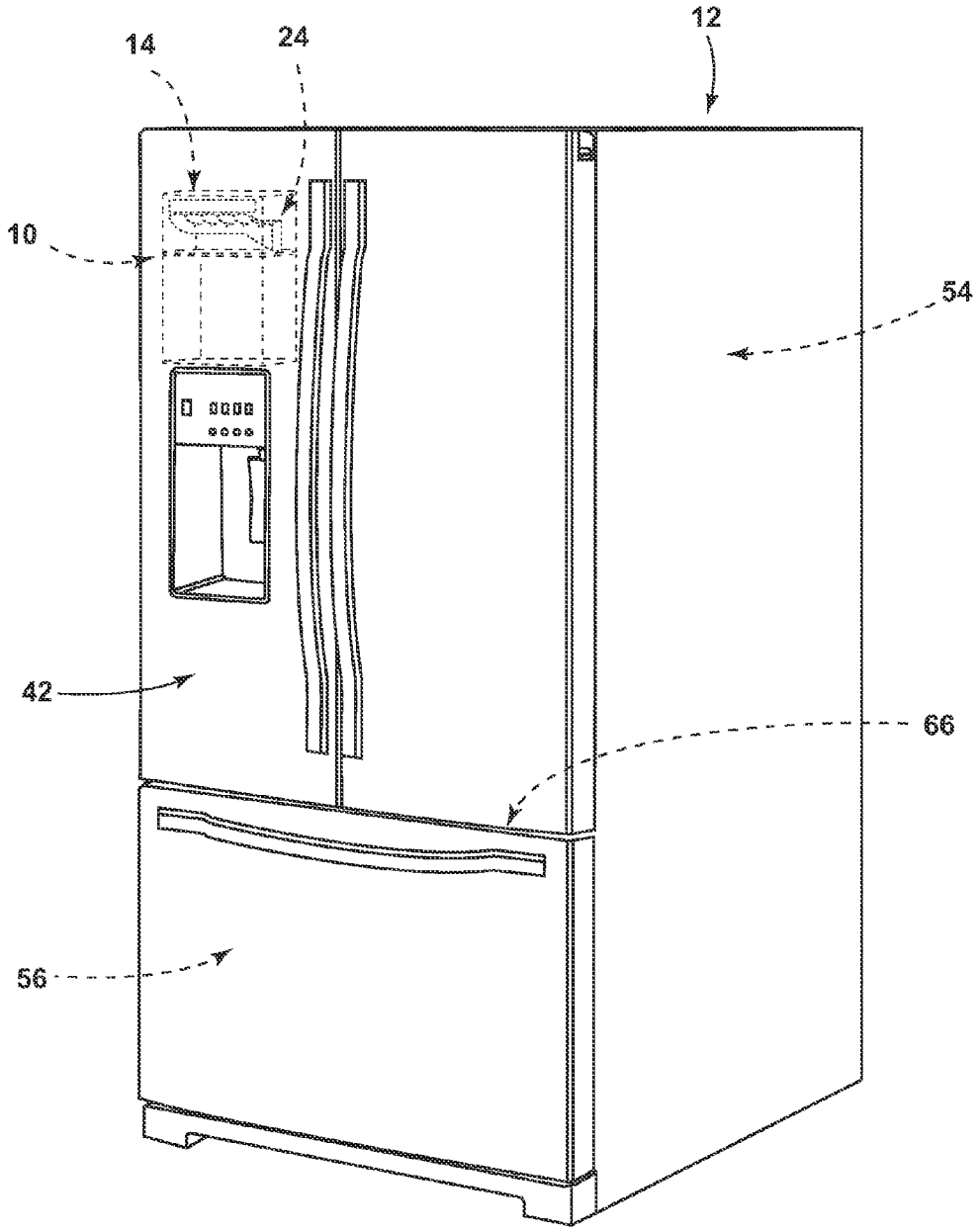
FIG. 1 is a front perspective view of a refrigerating appliance incorporating an ice maker utilizing an embodiment of an air flow diverter according to the present invention.

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

With respect to FIGS. 1-4, reference numeral 10 generally refers to an ice maker for a refrigerating appliance. The ice maker 10 includes an ice tray 14 having a plurality of ice-forming compartments 16. Each ice-forming compartment 16 includes sidewalls 18 and a base 20 defining an internal freezing chamber 22. An air flow diverter 24 is disposed proximate the ice tray 14 and includes an outer frame 26 and a plurality of internal diverting fins 28 defining a plurality of tuned duct flutes 30 for receiving a stream of intake air 32 from an air handling system of the refrigerating appliance 12. The tuned duct flutes 30 distribute the stream of intake air 32 as a plurality of streams of cooling air 34 moved in the direction of the plurality of ice-forming compartments 16. The plurality of internal diverting fins 28 are positioned at a predetermined spacing pattern 36 that individually tunes each of the plurality of tuned duct flutes 30. The predetermined spacing pattern 36 of the internal diverting fins 28 evenly distributes the stream of intake air 32 among the plurality of tuned duct flutes 30, such that each of the plurality of streams of cooling air 34 includes substantially equal air flow rates to each of the plurality of ice-forming compartments 16. According to the various embodiments, the predetermined spacing pattern 36 also defines a plurality of distribution apertures 38 that lead into the respective tuned duct flutes 30. Each of the distribution apertures 38 is individually sized according to the dimensional aspects of the individually sized tuned duct flutes 30. Additionally, each of the streams of cooling air 34 are exhausted from the respective plurality of tuned duct flutes 30 through exhaust apertures 40 positioned at ends of each of the tuned duct flutes 30. According to various embodiments, it is contemplated that each of the exhaust apertures 40 can have a substantially similar size.

Figure 8:
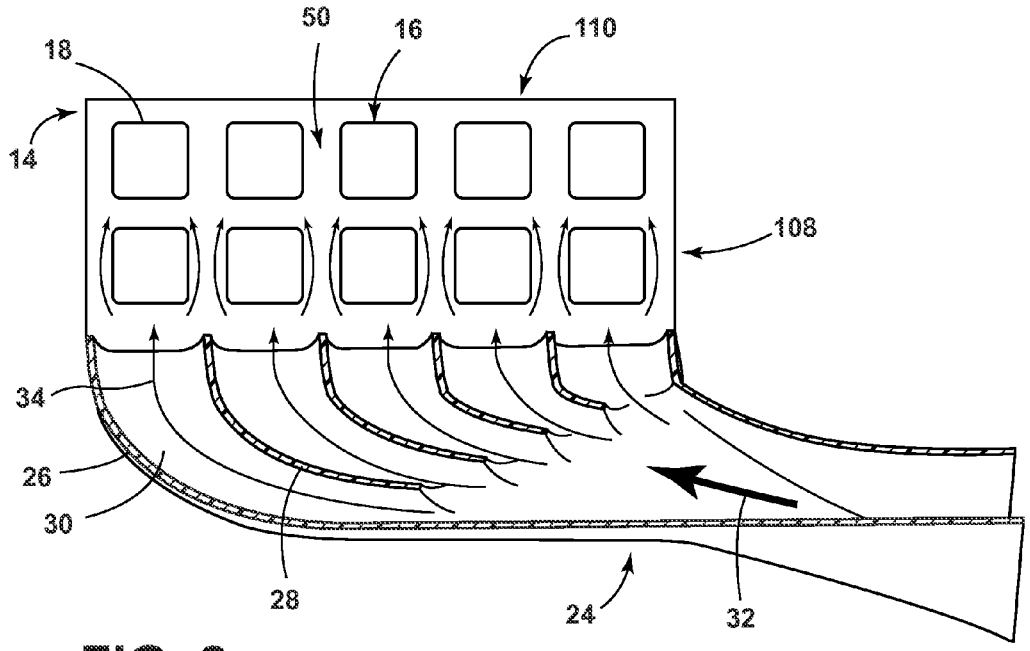
FIG. 8 is a schematic plan view of an ice tray having multiple rows of ice-forming compartments in conjunction with a single air flow diverter.

Referring again to FIGS. 1 and 2, an ice maker 10 for a refrigerating appliance 12 is generally disposed within or near one of the refrigerating or freezer compartments 54, 56 of the refrigerating appliance 12. In certain embodiments, the ice maker 10 can be disposed within a door 42 for the refrigerating appliance 12, such as in a French door or side-by-side refrigerating appliance. Within the ice maker 10, the ice tray 14 can include a plurality of internal freezing chambers 22 defined by sidewalls 18 for each of the ice-forming compartments 16. Accordingly, circulation channels 50 are defined within the ice tray 14 by the sidewalls 18 of each of the ice-forming compartments 16. In this embodiment, circulation channels 50 extend around an external surface 52 of each of the ice-forming compartments 16. In this manner, each of the plurality of streams of cooling air 34 is directed from the tuned duct flutes 30 of the air flow diverter 24 and through the exhaust apertures 40 of each of the tuned duct flutes 30. The streams of cooling air 34 can be directed into the circulation channels 50. It is contemplated that each of the streams of cooling air 34 can be directed at a respective ice-forming compartment 16 and also into one or more of the various circulation channels 50 of the ice tray 14. In this manner, each of the streams of cooling air 34 directed from the respective tuned duct flutes 30 can be circulated not only at a respective ice-forming compartment 16, but also can be made to flow around each of the ice-forming compartments 16 and into the air circulation channels 50 extending between and around each of the ice-forming compartments 16. The circulation of the streams of cooling air 34 through the various air circulation channels 50 can speed the freezing of the liquid within the internal freezing chambers 22. The air circulation channels 50 can also be used to distribute the streams of cooling air 34 to additional rows 108 of ice-forming compartments 16 within the ice tray 14 (illustrated in FIG. 8).

Figure 2:
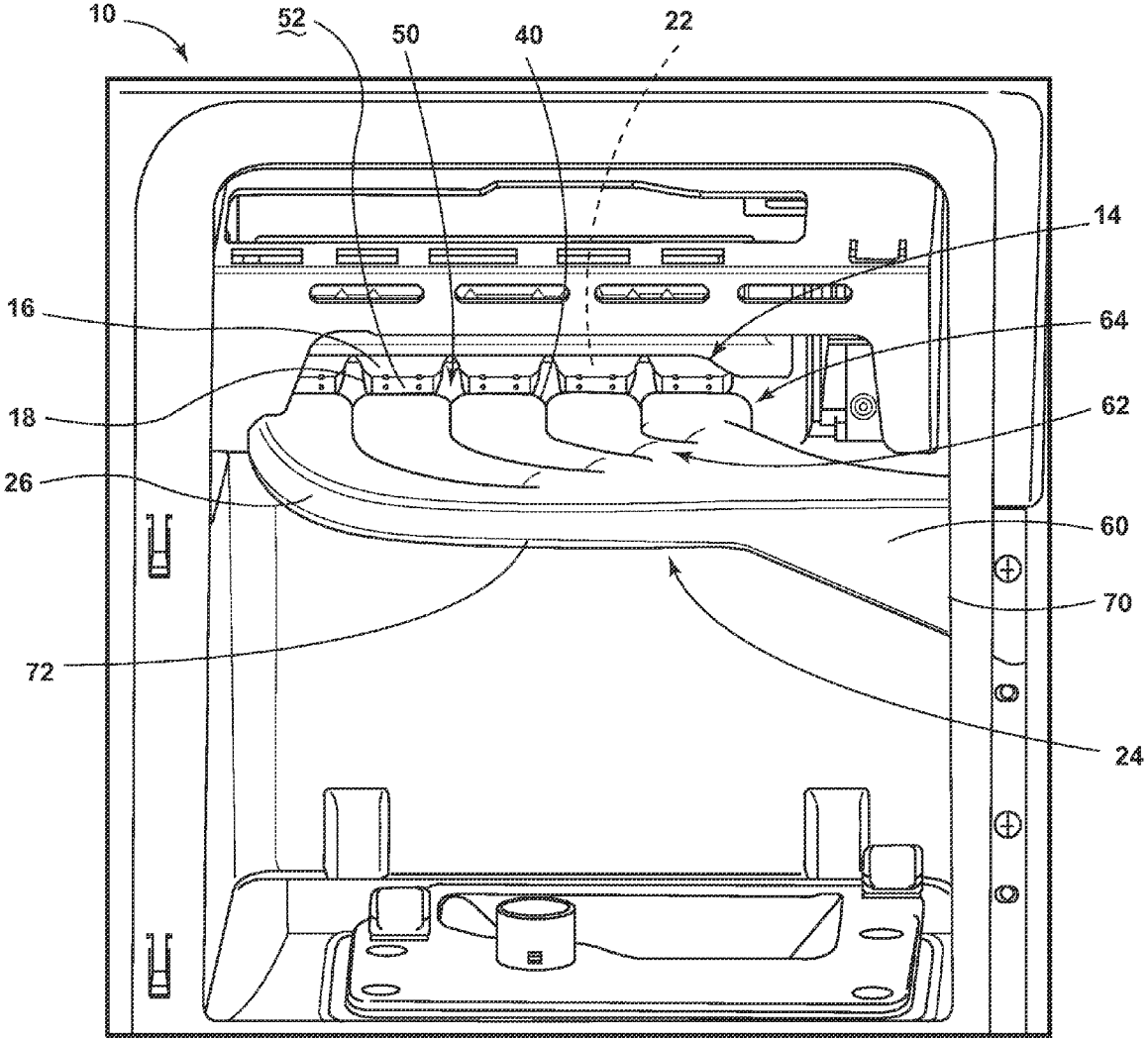
FIG. 2 is a front elevational view of an ice maker for a refrigerating appliance incorporating another aspect of the air flow diverter.
Figure 3:
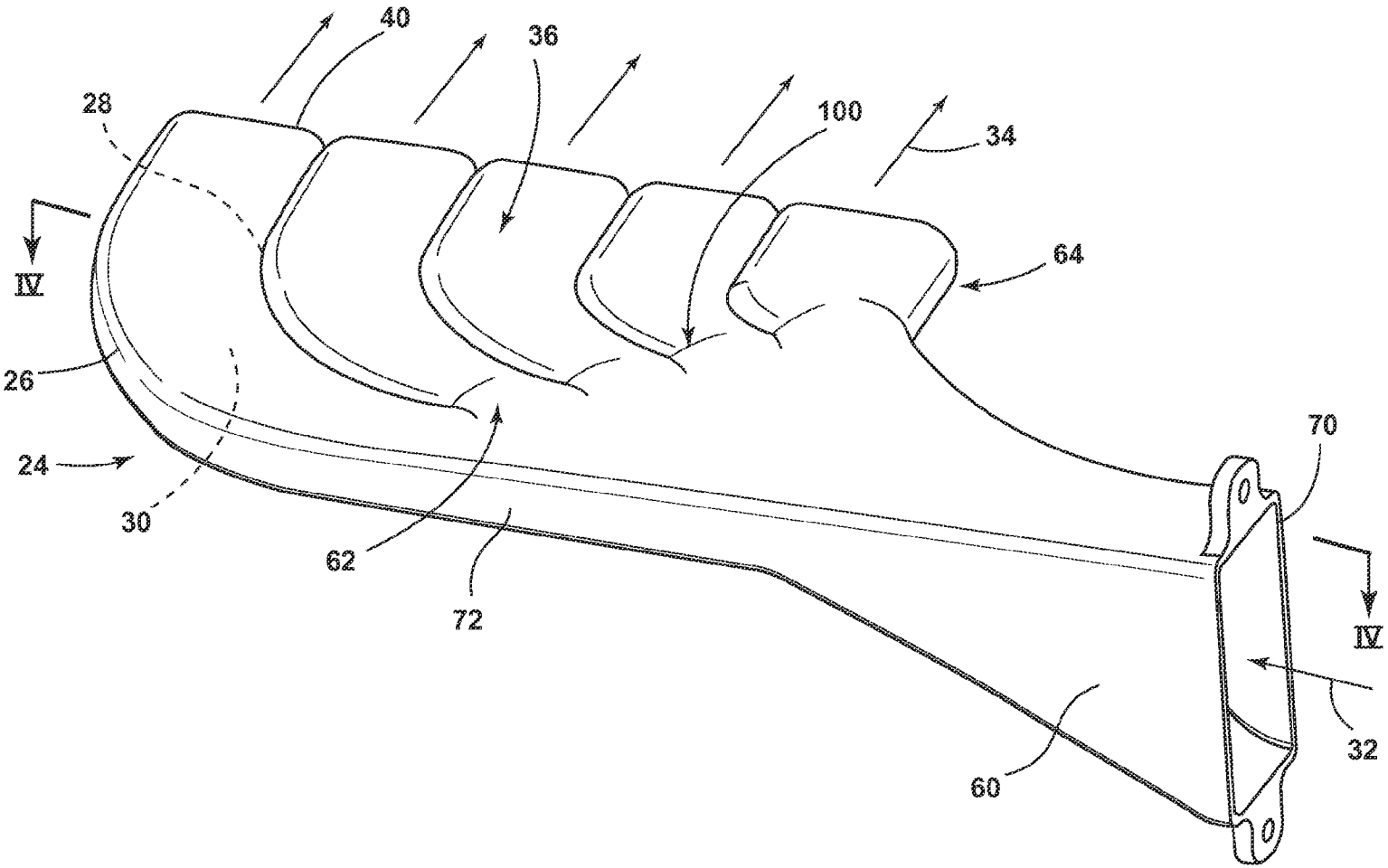
FIG. 3 is a top perspective view of another aspect of the air flow diverter.
Figure 4:
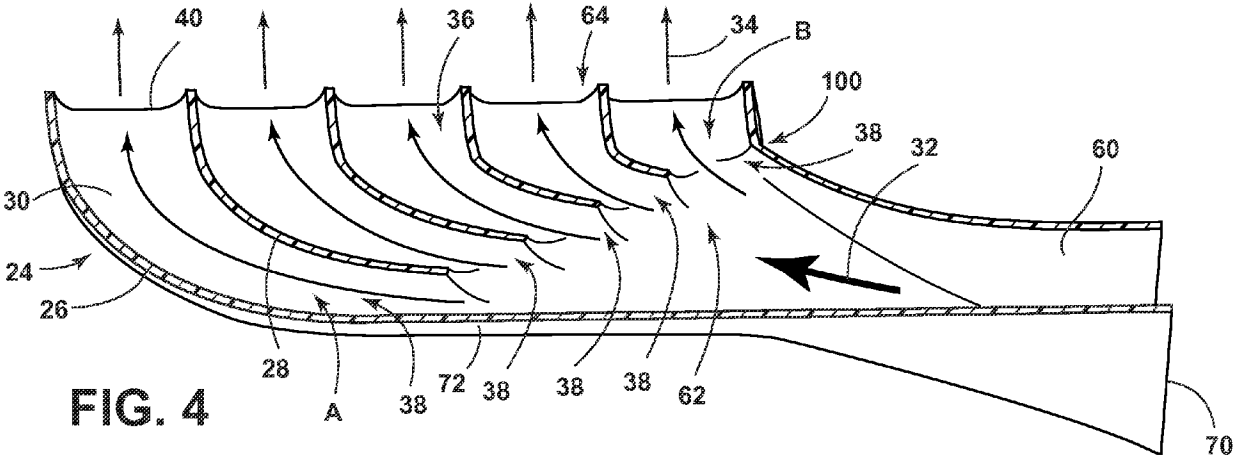
FIG. 4 is a cross-sectional view of the air flow diverter of FIG. 3 taken along line IV-IV.

Referring now to the embodiment illustrated in FIGS. 2-4, the air flow diverter 24 for the ice tray 14 disposed within the ice maker 10 for the refrigerating appliance 12 can include an air intake 60 for receiving intake air 32 from an air handler (not shown) of the refrigerating appliance 12. The air flow diverter 24 can also include a distribution region 62 and an exhaust portion 64 disposed within the air flow diverter 24 downstream of the air intake 60. The distribution region 62 and the exhaust portion 64 of the air flow diverter 24 are adapted to cooperate to direct a plurality of dedicated streams of cooling air 34 in the direction of a respective ice-forming compartment 16 defined within the ice tray 14. It is contemplated that the internal diverting fins 28 can be disposed within the distribution region 62 and spaced at the predetermined spacing pattern 36 to evenly distribute the intake air 32, generally comprising a single stream of intake air 32. The single air stream of intake air 32 can then be divided into the dedicated streams of cooling air 34 within the distribution region 62. In this manner, each of the dedicated streams of cooling air 34 can include substantially equal air flow rates.

Referring again to FIGS. 2-4, each of the internal diverting fins 28 is designed to be located at the predetermined spacing pattern 36 in order to equalize the air flow rate of each of the streams of cooling air 34. Accordingly, the water disposed within each of the internal freezing chambers 22 can be cooled at a substantially equal rate to form ice evenly and within a substantially similar time frame. In designing the predetermined spacing pattern 36 of the internal diverting fins 28, the position of the air intake 60 is one of the factors that can be considered in designing the predetermined spacing pattern 36.

As illustrated in FIGS. 2-4, the air intake 60 is disposed at one side 70 of the air flow diverter 24 such that air must be distributed among the various tuned duct flutes 30 sequentially positioned at increasing distances from the air intake 60. The air traveling farther within the air flow diverter 24 to ice-forming compartments 16 disposed farther from the air intake 60 may experience different static and dynamic pressures, and in turn, a different total pressure than a stream of cooling air 34 flowing through a shorter tuned duct flute 30 for delivering to an ice-forming compartment 16 positioned closer to the air intake 60 of the air flow diverter 24. Accordingly, in designing the predetermined spacing pattern 36 for each of the internal diverting fins 28, each of the internal diverting fins 28 can have a substantially different length, curvature, radius of bending, and other dimensional tolerances that can help to equalize the air flow rates among the various tuned duct flutes 30. Additionally, each of the tuned duct flutes 30 can be designed such that the predetermined spacing pattern 36 of the internal diverting fins 28 can allow for differently sized distribution apertures 38 that lead into each of the plurality of tuned duct flutes 30.

According to various embodiments, a longer tuned duct flute 30 may have a smaller distribution aperture 38 than a tuned duct flute 30 having a shorter length. Accordingly, in such an embodiment, the width of the distribution aperture 38 can be inversely related to the duct length of the tuned duct flute 30, such that a longer tuned duct flute 30 may have a narrower distribution aperture 38. According to various embodiments, the different sizes of the distribution apertures 38 can provide for differing amounts of a Venturi effect being exerted upon air flowing through each of the distribution apertures 38. Accordingly, in a narrower distribution aperture 38, for example, distribution aperture A in FIG. 4, a greater Venturi effect can cause the air flowing through the narrower distribution aperture 38 to move faster, at a decreased pressure, through the distribution aperture 38 and through a longer tuned duct flute 30. A greater velocity caused by a greater Venturi effect can be used to oppose greater static and dynamic pressures exerted upon the air moving through a longer tuned duct flute 30. Conversely, a shorter tuned duct flute 30 may have a wider distribution aperture 38, for example, distribution aperture B in FIG. 4, such that a lesser Venturi effect is placed upon the air moving through the wider distribution aperture 38. In this embodiment, a lesser Venturi effect may be necessary as the tuned duct flute 30 has a lesser length, such that the air moving through the shorter tuned duct flute 30 experiences less static and dynamic, and in turn, total pressure, as the air moves through the shorter tuned duct flute 30.

According to the various embodiments, the predetermined spacing pattern 36 of the internal diverting fins 28 can also be determined according to more empirical methods using computer air flow models for various designs of the air flow diverter 24 in the individual internal diverting fins 28 to arrive at the appropriate predetermined spacing pattern 36 of the internal diverting fins 28 to ensure a substantially even air flow rate among the plurality of streams of cooling air 34. In additional to air flow computer models, physical models of various embodiments of the air flow diverter 24 could be made and various anemometers can be disposed at each of the exhaust apertures 40 of the tuned duct flutes 30. The individual internal diverting fins 28 can be moved relative to one another according to the various readings of the anemometers to ensure that the air flow rates through each of the tuned duct flutes 30 are substantially equal.

According to various embodiments, a combination of these methods of determining the predetermined spacing pattern 36 of the internal diverting fins 28 can be used. Accordingly, calculations of static and dynamic pressures in addition to the use of computer models and anemometer readings can be used in cooperation to determine the appropriate spacing of the internal diverting fins 28.

Figure 5:
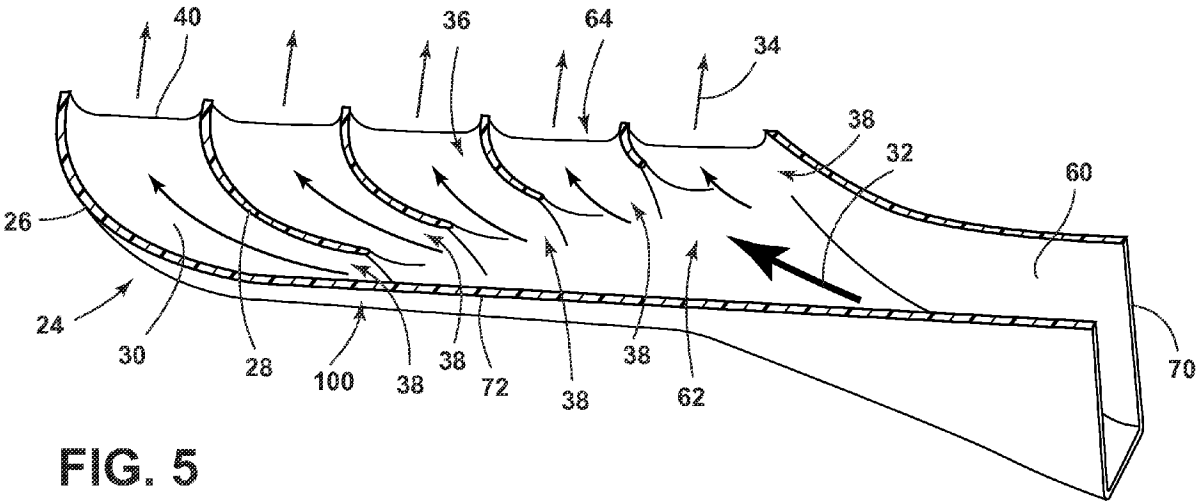
FIG. 5 is a cross-sectional view of the air flow diverter of FIG. 4 incorporating an alternate predetermined spacing pattern for the internal diverting fins.

Referring now to FIGS. 4 and 5, as the various designs of the air flow diverter 24 and the predetermined spacing pattern 36 of the internal diverting fins 28 is derived, the length, spacing, radius, and other dimensional characteristics of each of the internal diverting fins 28 can be modified to ensure a consistent air flow rate among each of the tuned duct flutes 30. Additionally, each model of refrigerating appliance 12 may require an ice maker 10 having different dimensional characteristics than other refrigerating appliances 12 such that the air flow diverter 24 for each individual ice maker 10 must be separately designed to achieve the same consistent air flow rates amongst the various tuned duct flutes 30 of the air flow diverter 24 for each ice maker 10.

In configurations of the air flow diverter 24 where the air intake 60 is disposed to one side 70 of the air flow diverter 24 and air is delivered sequentially to the various tuned duct flutes 30, it is contemplated that the internal diverting fins 28 are disposed in a substantially non-parallel arrangement. Additionally, it is contemplated that the various internal diverting fins 28, where the internal diverting fins 28 curve toward the exhaust apertures 40, can also be configured in a non-concentric arrangement, such that the curvature of each of the internal diverting fins 28 has a substantially custom designed radial length.

According to various embodiments, depending upon the location of the ice maker 10 to be disposed within a respective refrigerating appliance 12, the air intake 60 can be positioned in various locations within the air flow diverter 24. As illustrated in FIGS. 1-5, where the ice maker 10 is disposed within the door 42 of the refrigeration appliance 12, the ice maker 10 will have a relatively thin profile such that the air intake 60 from the air handler of the refrigerating appliance 12 pushes air into the air flow diverter 24 from a side 70 of the air flow diverter 24. Air is then delivered sequentially through the various tuned duct flutes 30 for delivery toward each of the ice delivery compartments. In various alternate embodiments, the air intake 60 can be centrally located within the air flow diverter 24, either from above or below the ice maker 10. In such an embodiment, where the air intake 60 is centrally located within the air flow diverter 24, there is generally a lesser degree of variation between the outermost tuned duct flutes 30 and the innermost tuned duct flutes 30 such that there may be lesser variation of the predetermined spacing pattern 36 between the internal diverting fins 28.

It is contemplated that the ice maker 10 for the refrigerating appliance 12 can be disposed within the freezer compartment 56, a mullion of the refrigerating appliance 12, or a pantry-drawer area of the refrigerating appliance 12 such that a centrally located air intake 60 for the air flow diverter 24 can be utilized. When located proximate the center 72 of the air flow diverter 24, the air intake 60 can provide air more directly toward the distribution apertures 38 and, in turn, the exhaust apertures 40, such that lesser variation between the various internal diverting fins 28 may be implemented. Regardless of the application of the ice maker 10 within the various refrigerating appliances 12, individual tuning of the various internal diverting fins 28 for the air flow diverter 24 is to be conducted according to the various embodiments disclosed herein in order to ensure substantially consistent air flow rates through each of the tuned duct flutes 30 in order to provide even cooling for the ice formed within the internal freezing chambers 22.

Figure 6:
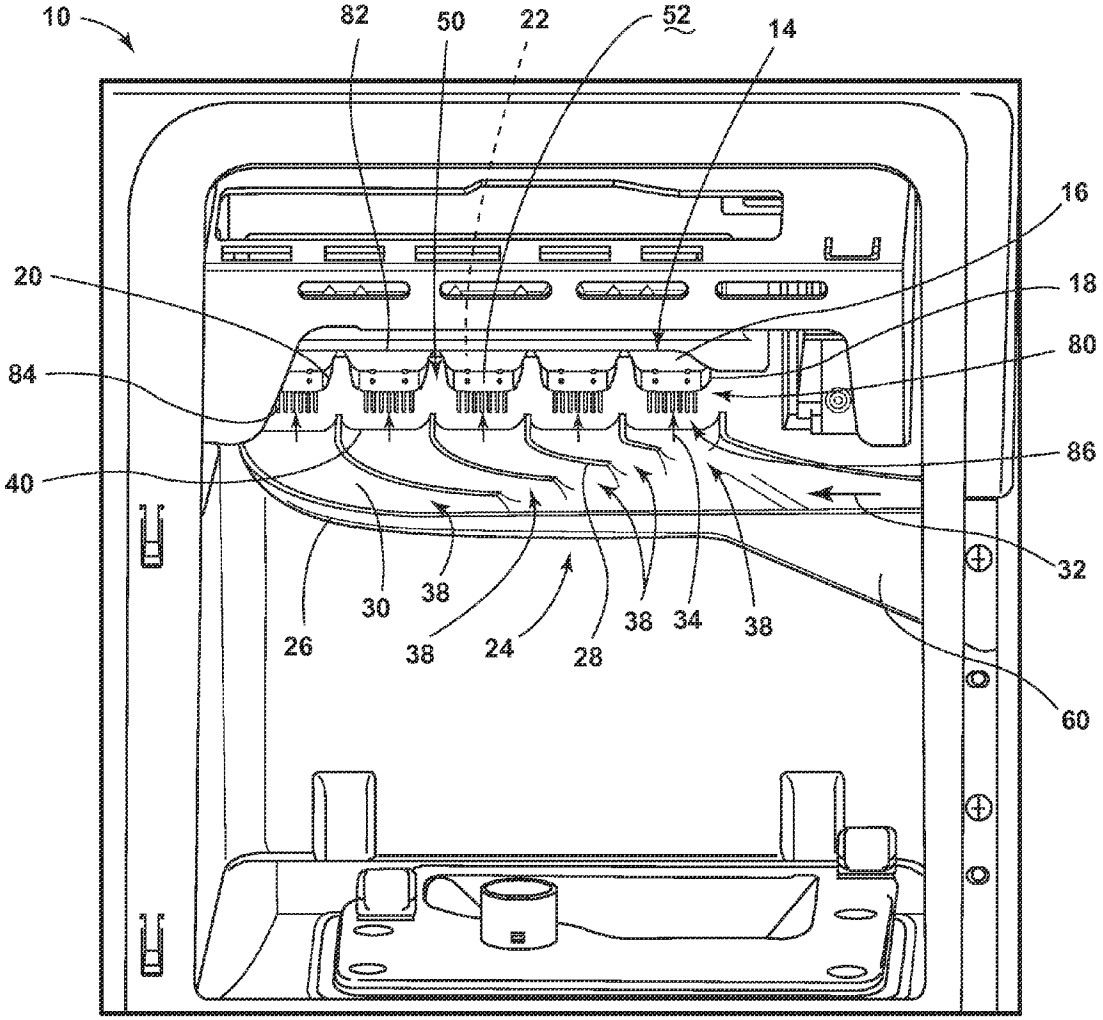
FIG. 6 is a partial internal elevational view of another alternate embodiment of the ice maker incorporating the air flow diverter of FIG. 2, with the air flow diverter shown in a cross-sectional view.
Figure 7:
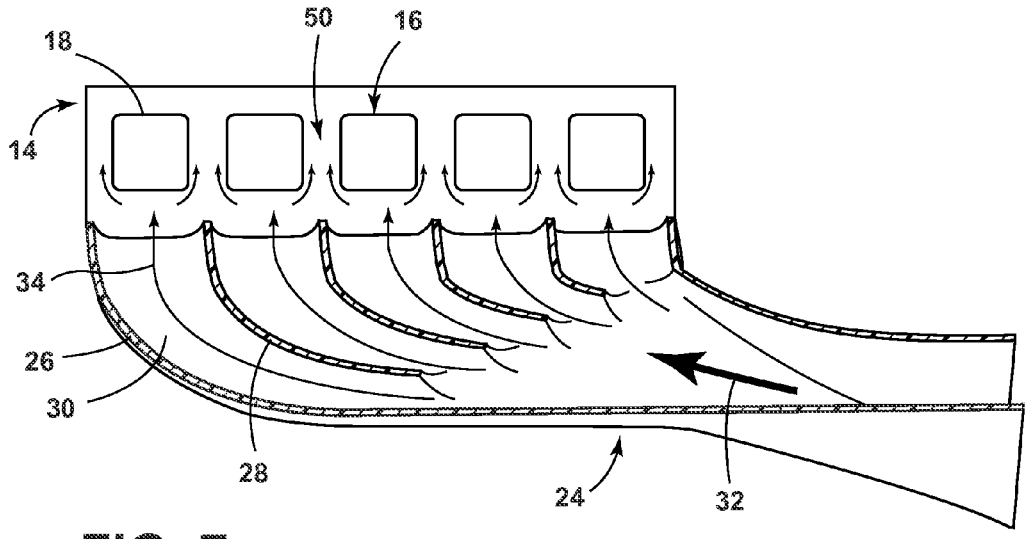
FIG. 7 is a schematic plan view of an ice tray having a single row of ice-forming compartments in conjunction with one air flow diverter.

Referring now to FIG. 6, each of the ice-forming compartments 16 can include a heat sink 80 placed in communication with a respective internal freezing chamber 22. It is contemplated that each of the heat sinks 80 can extend from a base 20 of each of the ice-forming compartments 16. In this embodiment, a portion of each of the streams of cooling air 34 can be directed toward the heat sinks 80 such that each heat sink 80 can retain cooling from the various streams of cooling air 34. This cooling can then be directed upward and into the respective internal freezing chamber 22. In this manner, the heat sinks 80 can encourage cooling from below, through the base 20, such that the water within each of the internal freezing chambers 22 freezes from bottom to the top. According to various embodiments, each of the ice-forming compartments 16 can include an open top for receiving water from a water distribution system (not shown) of a refrigerating appliance 12. Because the top 82 of the ice-forming compartment 16 is open, as the ice tends to freeze from the bottom towards the top, unfrozen water is permitted to expand in an upward direction such that the formation of air bubbles within the ice formed within the internal freezing chamber 22 can be minimized such that substantially clear ice can be formed within the internal freezing chambers 22. In this manner, as the heat sink 80 receives cooling from the various streams of cooling air 34, the heat sinks 80, being in communication with the internal freezing chamber 22, delivers cooling from below into the internal freezing chamber 22.

Referring again to FIG. 6, each of the heat sinks 80 of the various ice-forming compartments 16 can include a plurality of downwardly extending members 84 in the forms of plates, tines, or other substantially elongate members configured to receive and retain cooling from the respective streams of cooling air 34 from the air flow diverter 24. It is contemplated that each of the heat sinks 80 can include internal air flow gaps 86 between the various downwardly extending members 84 for allowing the various streams of cooling air 34 to flow within the air flow gaps 86 of the heat sink 80 to more evenly distribute cooling throughout the entire heat sink 80 for thermal delivery into the respective internal freezing chamber 22 of the various ice-forming compartments 16. It is contemplated that each of the heat sinks 80 can be made of various materials having substantially high thermal retention and delivery properties, where such materials can include, but are not limited to, aluminum alloys, copper, various alternate metals, polymers, composite materials, combinations thereof, and other similar thermally conductive materials.

Referring again to FIGS. 3 and 4, the predetermined spacing pattern 36 of the internal diverting fins 28 can define a plurality of intake apertures positioned proximate a transition area 100 between the air intake 60 and the distribution region 62 of the air flow diverter 24. In such an embodiment, each of the intake apertures is individually sized to have a width sufficiently sized to provide a substantially even flow rate for the streams of cooling air 34 when the streams of cooling air 34 leave the exhaust apertures 40 of the air flow diverter 24. It is contemplated that each of the exhaust apertures 40 of the air flow diverter 24 can have a substantially similar width and overall size. It is also contemplated that in various embodiments, each of the exhaust apertures 40 can also be individually sized to assist in providing for a substantially even flow rate of the various streams of cooling air 34 directed toward the ice-forming compartments 16.

It is contemplated that the air handling system for the refrigerating appliance 12 can include an air handling assembly for delivering a substantially consistent flow of intake air 32 into the air flow diverter 24. It is also contemplated that this single stream of intake air 32 can have a substantially consistent temperature. In this manner, because the volume and temperature of air delivered to the air intake 60 of the air flow diverter 24 can be substantially consistent, a single design for the predetermined spacing pattern 36 of the internal diverting fins 28 can be accomplished during the design phase of the particular refrigerating appliance 12. By substantially minimizing the variables as to the intake air 32, the design of the predetermined spacing pattern 36 of the internal diverting fins 28 can be configured to most effectively insure a consistent air flow rate out of each of the tuned duct flutes 30 within the air flow diverter 24.

Referring now to FIGS. 2 and 6-9, it is contemplated that the ice tray 14 of the ice maker 10 can include a single row 108 of ice-forming compartments 16 where each of the tuned duct flutes 30 is configured to deliver air to a single ice-forming compartment 16 defined within the ice tray 14. According to various alternate embodiments, the ice tray 14 can include a plurality of rows 108 of ice-forming compartments 16, such as two, three or more rows 108 of ice-forming compartments 16 (shown in FIG. 8). In such an embodiment, the streams of cooling air 34 from each of the tuned duct flutes 30 is delivered to a column 110 of ice-forming compartments 16 formed by the rows 108 of ice-forming compartments 16 being placed in a grid-type pattern. A plurality of heat sinks 80 can also be coupled to each ice-forming compartment 16 within the column 110 of ice-forming compartments 16. In this manner, ice within each of the ice-forming compartments 16 within a column 110 of ice-forming compartments 16 forms at different rates. Ice-forming compartments 16 nearer the exhaust aperture 40 of a particular tuned duct flute 30 may form ice faster than ice within an ice-forming compartment 16 that is farther away from the exhaust aperture 40. It is contemplated that ice within each of the respective columns 110 of ice-forming compartments 16 forms at a substantially consistent rate such that, regardless of the number of ice-forming compartments 16 within each column 110, ice will form consistently within each column 110 of ice-forming compartments 16 due to the consistent air flow rate emanating from each of the tuned duct flutes 30.

Figure 9:
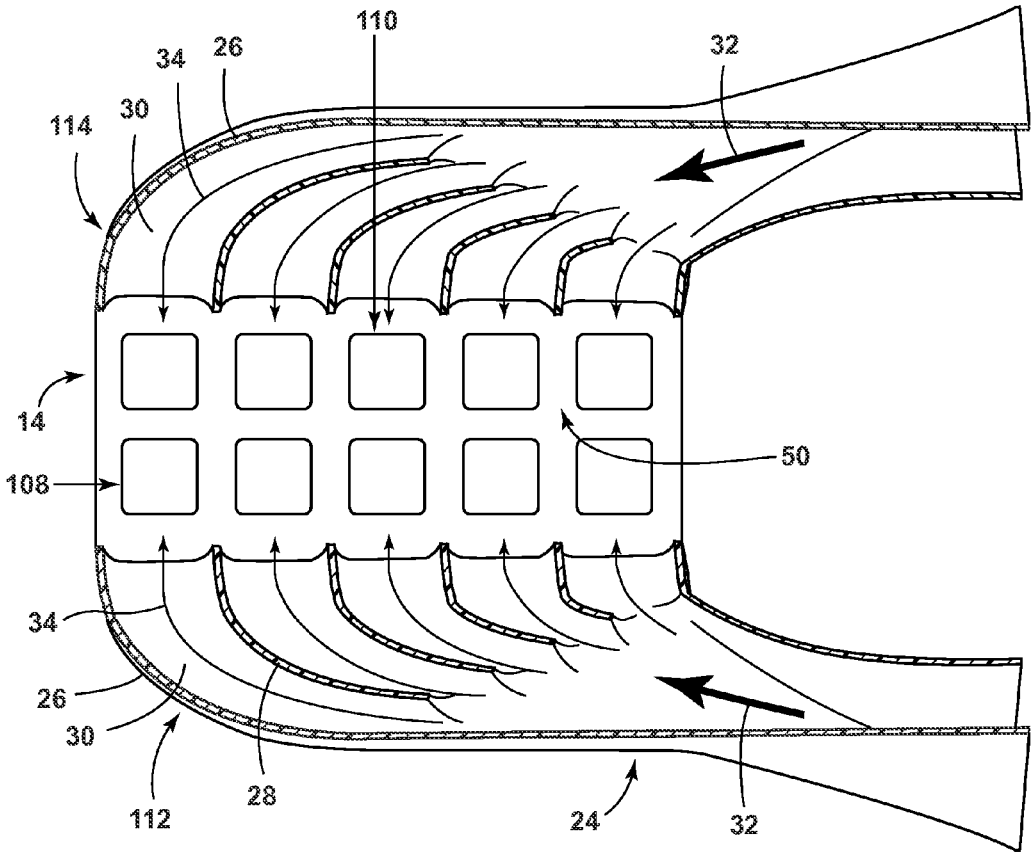
FIG. 9 is a schematic plan view of an ice tray having multiple rows of ice-forming compartments in conjunction with two opposing air flow diverters.

According to various embodiments, as illustrated in FIG. 9, where the ice tray 14 includes more than one row 108 of ice-forming compartments 16, the ice maker 10 can include more than one air flow diverter 24. In such an embodiment, such as where the ice tray 14 includes two rows 108 of ice-forming compartments 16, the ice maker 10 can include a front and rear air flow diverter 112, 114 for delivering substantially consistent streams of cooling air 34 to both sides of the ice tray 14 to cool each row 108 of ice-forming compartments 16 at a substantially consistent rate.

Figure 10:
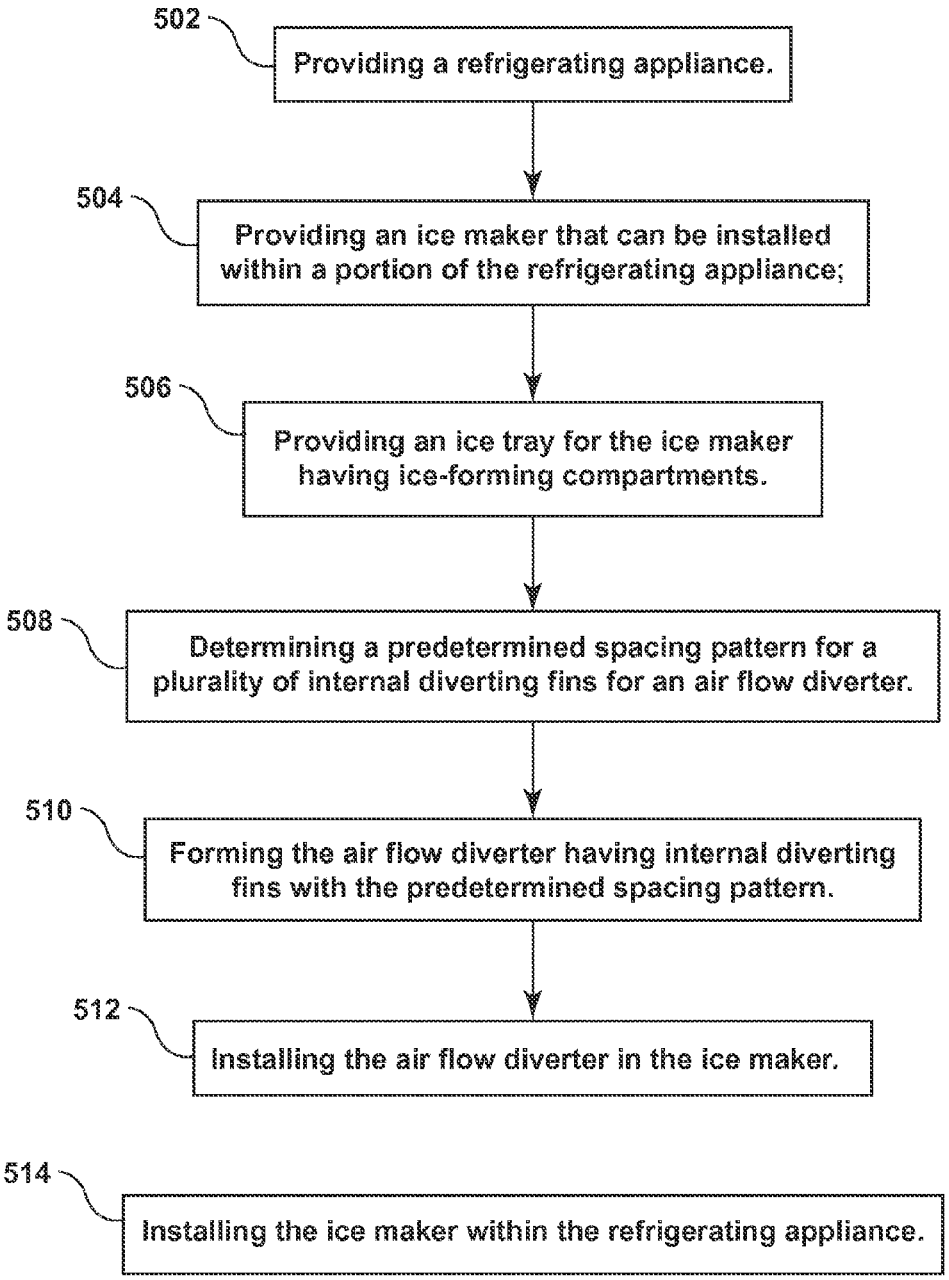
FIG. 10 is a schematic flow diagram illustrating a method for forming an ice making apparatus for a refrigerating appliance.

Referring now to FIG. 10, having described the various embodiments of the air flow diverter 24 for the ice maker 10, a method is disclosed for forming an ice making apparatus for a refrigerating appliance 12, according to one embodiment. It is contemplated that the method of forming an ice making apparatus can include the step of providing a refrigerating appliance 12 having a water and air distribution system that can be connected or otherwise placed in communication with the ice making apparatus. In order to form ice, it is necessary for water to be delivered to the ice tray 14 within the ice making apparatus and also for cool air to be delivered to the ice making apparatus in order to cool the water to form ice. An ice maker 10 can generally be installed within a portion of the refrigerating appliance 12. According to various embodiments, the ice maker 10 can be installed within various portions of the refrigerating appliance 12. Such locations can include, but are not limited to, door 42, a freezing compartment 56, a refrigerating compartment 54, a vertical mullion, a horizontal mullion 66, and other similar locations within the refrigerating appliance 12. It is also contemplated that the ice maker 10 can include an ice tray 14 having a plurality of ice-forming compartments 16. As discussed above, each of the ice-forming compartments 16 includes sidewalls 18 and a base 20 defining an internal freezing chamber 22 for each of the ice-forming compartments 16. It is contemplated that, in various embodiments, each of the ice-forming compartments 16 can include multiple internal freezing chambers 22, where the ice-forming compartments 16 includes various internal partition walls for separating the internal freezing chamber 22 into multiple subcompartments within which smaller cubes of ice can be formed.

Once the respective designs for the refrigerating appliance 12, ice maker 10, and ice tray 14 have been determined, the method includes the step of determining the predetermined spacing pattern 36 for the plurality of internal diverting fins 28 disposed within an air flow diverter 24 for the selected ice maker 10. As discussed above, the predetermined spacing pattern 36 is configured to evenly distribute intake air 32 from the air distribution system of the refrigerating appliance 12. The air flow diverter 24, based upon the predetermined spacing pattern 36 of the internal diverting fins 28, is configured to distribute the intake air 32 into dedicated streams of cooling air 34 separately manipulated by the individually tuned duct flutes 30 defined between the adjacent internal diverting fins 28. In this manner, when each of the internal diverting fins 28 is located in the predetermined spacing pattern 36, each of the dedicated streams of cooling air 34 flowing through the individual tuned duct flutes 30 has substantially equal air flow rates such that substantially equal volumes of air could be delivered to each row 108 of the ice-forming compartments 16 of the ice tray 14, or in fact each individual ice-forming compartment 16.

Once the predetermined spacing pattern 36 for the plurality of internal diverting fans is designed, the air flow diverter 24 is formed. Included within the air flow diverter 24 is an intake configured to be coupled to the air distribution system for the refrigerating appliance 12. A distribution region 62 of the air flow diverter 24 at least partially includes a portion of the internal diverting pin is positioned in the predetermined spacing pattern 36.

An exhaust portion 64 of the air flow diverter 24 includes the various exhaust apertures 40 of the respective tuned duct flutes 30. Accordingly, each air flow diverter 24 is specifically designed for the particular refrigerating appliance 12 and ice maker 10 disposed therein. As discussed above, each ice maker 10 can have a differently configured ice tray 14 including various configurations of ice-forming compartments 16. These configurations can include multiple rows 108 of ice-forming compartments 16, columns 110 of ice-forming compartments 16 and other similar ice-forming compartment configurations. It is contemplated that in these various embodiments, the design of the air flow diverter 24 is configured to provide for substantially consistent ice formation within each of the ice-forming compartments 16, such that the various rows 108 of ice-forming compartments 16 disposed within the ice tray 14 forms substantially complete ice cubes at substantially the same time. By ensuring a substantially consistent flow of air out of each of the tuned duct flutes 30, ice can be formed substantially at the same time within each of the ice-forming cavities, or columns 110 of the ice-forming cavities. Accordingly, energy can be saved by having ice form within each of the columns 110 of ice-forming cavities at substantially the same time, such that additional cooling is not utilized to cool water within a single ice-forming compartment 16 when ice has already formed in each of the other similarly situated ice-forming compartments 16.

During the design phase of each of the internal diverting fins 28, it is necessary to also minimize the amount of turbulence experienced within each of the tuned duct flutes 30. In this manner, the minimization of turbulence can serve to provide for the more efficient delivery of the various streams of cooling air 34 towards the ice-forming compartments 16. Excessive turbulence can cause air to circulate within each of the tuned duct flutes 30 rather than being directed towards the ice-forming compartments 16. Accordingly, in designing the predetermined spacing pattern 36 of the internal diverting fins 28, each of the internal diverting fins 28 is designed to minimize friction losses within each of the tuned duct flutes 30 and also minimize turbulence experienced by each of the streams of cooling air 34 flowing through the respective tuned duct flutes 30.

One method of minimizing turbulence and friction is to ensure the tuned duct flutes 30 are substantially arcuate and have minimal angular sections disposed therein. Another method of minimizing friction and turbulence is to ensure that each of the tuned duct flutes 30 is substantially smooth on the internal surface. It is contemplated that the texture of the internal surface of the various tuned duct flutes 30 and also minimal increases in turbulence can be used as features that can substantially equalize the flow rates of each of the streams of cooling air 34 delivered to the ice-forming compartments 16. It is contemplated that the use of friction or turbulence-causing features within each of the tuned duct flutes 30 should be minimized in order to maximize the efficiency of the entire system.

In use, the airflow diverter 24 is used in conjunction with the cold air delivery system and the water delivery systems of the refrigerating appliance 12 for forming ice within each of the ice-forming compartments 16 of the ice tray 14. Water is disposed within each of the internal freezing chambers 22 of each of the ice-forming compartments 16. The cold air delivery system then delivers cold air, such as from an evaporator or similar heat exchanger disposed in the refrigerating appliance 12. The cold air is delivered to the air flow diverter 24, where the tuned duct flutes 30, designed as described herein into the predetermined spacing pattern 36, delivers the plurality of streams of cooling air 34 to each of the ice-forming compartments 16 or rows 108 of ice-forming compartments 16. Due to the predetermined spacing pattern 36 of the tuned duct flutes 30, all of the streams of cooling air 34 have a substantially equal air flow rate. It is contemplated that because of the substantially equal flow rates of the streams of cooling air 34, the liquid within the ice-forming compartments 16 will turn to ice at a substantially uniform rate within each ice-forming compartment 16 or within each row 108 of ice-forming compartments 16. Once the ice is formed, the ice maker 10 will operate to remove the ice from the internal freezing chamber 22 of each ice-forming compartment 16. The process then can begin again, where additional ice is desired.

The invention claimed is:

1. An ice maker for a refrigerating appliance, the ice maker comprising:

an ice tray having a plurality of ice-forming compartments, each of the ice-forming compartments including sidewalls and a base that defines an internal freezing chamber; and an air flow diverter having an outer frame and a plurality of internal diverting fins that define a plurality of tuned duct flutes for receiving a stream of intake air from an air handling system and distributing the stream of intake air through the plurality of tuned duct flutes and as a plurality of streams of cooling air in a direction of the plurality of ice-forming compartments, wherein each of the plurality of internal diverting fins includes a predetermined spacing pattern that individually tunes each of the plurality of tuned duct flutes, and wherein the predetermined spacing pattern evenly distributes the stream of intake air among the plurality of tuned duct flutes such that each of the plurality of streams of cooling air include substantially equal air flow rates to each of the plurality of ice-forming compartments, wherein each of the plurality of internal diverting fins includes a substantially different length from a respective distribution aperture to a respective exhaust aperture and are disposed in a non-parallel arrangement, wherein the predetermined spacing pattern defines a plurality of distribution apertures that lead to respective tuned duct flutes of the plurality of tuned duct flutes, wherein each of the plurality of distribution apertures is individually sized to have a width that is inversely related to a length of the respective tuned duct flute.

2. The ice maker of claim 1, wherein the plurality of ice-forming compartments include a heat sink engaged with an external surface of the ice-forming compartments and in thermal communication with the internal freezing chamber.

3. The ice maker of claim 2, wherein heat sinks extend from the base of each ice-forming compartment and wherein a portion of each of the plurality of streams of cooling air is directed toward the heat sinks.

4. The ice maker of claim 1, wherein the plurality of streams of cooling air are directed into circulation channels defined by the sidewalls of each of the ice-forming compartments, wherein the circulation channels extend around an external surface of each of the ice-forming compartments.

5. The ice maker of claim 1, wherein the plurality of streams of cooling air are exhausted from the respective plurality of tuned duct flutes through exhaust apertures positioned at ends of each of the plurality of tuned duct flutes, wherein each of the exhaust apertures are substantially similar in size.

6. An ice maker for a refrigerating appliance, the ice maker comprising:

an ice tray having a plurality of ice-forming compartments, each of the ice-forming compartments including sidewalls and a base that defines an internal freezing chamber; and an air flow diverter having an air intake for receiving intake air from an air handler, a distribution region and an exhaust portion, wherein the distribution region and the exhaust portion cooperate to direct a plurality of dedicated streams of cooling air toward respective ice-forming compartments of the plurality of ice-forming compartments; and a plurality of internal diverting fins disposed within the distribution region and spaced at a predetermined spacing pattern to evenly distribute the intake air into the dedicated streams of cooling air, wherein each of the dedicated streams of cooling air include substantially equal air flow rates to each of the plurality of ice-forming compartments, wherein each of the plurality of internal diverting fins defines a plurality of tuned duct flutes, and wherein the exhaust portion of the air flow diverter includes respective exhaust apertures positioned at ends of each of the plurality of tuned duct flutes, wherein the plurality of streams of cooling air are exhausted from the respective plurality of tuned duct flutes through the exhaust apertures, wherein each of the exhaust apertures are substantially similar in size.

7. The ice maker of claim 6, wherein each of the plurality of tuned duct flutes corresponds to a respective ice-forming compartment.

8. The ice maker of claim 6, wherein each of the plurality of internal diverting fins has a substantially different length and are disposed in a non-parallel and non-concentric arrangement.

9. The ice maker of claim 7, wherein the predetermined spacing pattern defines a plurality of intake apertures positioned proximate a transition area between the air intake and the distribution region, wherein each of the plurality of intake apertures is individually sized to have a width that is inversely related to a duct length of the respective tuned duct flute.

10. The ice maker of claim 6, wherein the intake air includes a single air stream at a temperature capable of forming ice directed into the air intake of the air flow diverter.

11. The ice maker of claim 6, wherein each of the plurality of ice-forming compartments include a heat sink engaged with an external surface of the ice-forming compartments and in thermal communication with the internal freezing chamber, wherein each of the heat sinks extend from a corresponding base of each ice-forming compartment, and wherein a portion of each of the plurality of streams of cooling air is directed toward the heat sinks.

12. The ice maker of claim 6, wherein each of the plurality of streams of cooling air are at least partially directed into circulation channels defined by the sidewalls of each of the ice-forming compartments, wherein the circulation channels extend around an external surface of each of the ice-forming compartments.

13. A method of forming an ice making apparatus for a refrigerating appliance, the method including steps of:

providing a refrigerating appliance having a water distribution system and an air distribution system that can each be connected to an ice making apparatus;

providing an ice maker that can be installed within a portion of the refrigerating appliance, wherein the ice maker can be installed within at least one of a door of the refrigerating appliance, a freezing compartment, a refrigerating compartment, and a mullion;

providing an ice tray for the ice maker, wherein the ice tray includes a plurality of ice-forming compartments, each of the ice-forming compartments including sidewalls and a base that defines an internal freezing chamber;

determining a predetermined spacing pattern for a plurality of internal diverting fins disposed within an air flow diverter, wherein the predetermined spacing pattern is configured to evenly distribute intake air from the air distribution system into dedicated streams of cooling air that are separately manipulated by individual tuned duct flutes defined between adjacent internal diverting fins of the plurality of internal diverting fins, and wherein each of the dedicated streams of cooling air include substantially equal air flow rates;

forming the air flow diverter having an air intake configured to be coupled to the air distribution system, a distribution region and an exhaust portion, and wherein the plurality of internal diverting fins are positioned in the predetermined spacing pattern within the distribution region to form the individual tuned duct flutes;

installing the air flow diverter in the ice maker such that each of the individual tuned duct flutes is configured to direct a dedicated stream of cooling air toward a respective ice-forming compartment; and installing the ice maker within the refrigerating appliance and connecting the air intake to the air distribution system and placing the water distribution system in communication with the internal freezing chambers, wherein the predetermined spacing pattern defines a plurality of intake apertures positioned proximate a transition area between the air intake and the distribution region, wherein each of the plurality of intake apertures is individually sized to have a width that is inversely related to a duct length of the respective tuned duct flute.

14. The method of claim 13, wherein the ice tray includes dedicated heat sinks in thermal communication with respective internal freezing chambers, and wherein a portion of the dedicated streams of cooling air are directed toward the heat sinks.

15. The method of claim 13, wherein the exhaust portion of the air flow diverter includes respective exhaust apertures positioned at ends of each of the tuned duct flutes, wherein the plurality of streams of cooling air are exhausted from the respective tuned duct flutes through the exhaust apertures, wherein each of the exhaust apertures are substantially similar in size.

16. The method of claim 13, wherein the ice-forming compartments are separated to define circulation channels that extend around an external surface of each of the ice-forming compartments, and wherein a portion of each of the dedicated streams of cooling air are directed into the circulation channels.

* * * * *